United States Patent [19]

Buckland

[11] Patent Number: 4,905,602

[45] Date of Patent: Mar. 6, 1990

[54] SPIN-DAMPED TRAINING ROUND WITH SELECTABLE SAFETY TRACE

[75] Inventor: Roy W. Buckland, Croydon, England

[73] Assignee: Royal Ordnance, England

[21] Appl. No.: 199,366

[22] Filed: May 23, 1988

Related U.S. Application Data

[63] Continuation of Ser. No. 57,264, Apr. 29, 1987, abandoned.

[30] Foreign Application Priority Data

Apr. 29, 1986 [GB] United Kingdom ..... 8610509

[51] Int. Cl.[4] ..... F42B 13/16

[52] U.S. Cl. ..... 102/520; 102/501; 102/517; 102/522; 102/529; 244/324

[58] Field of Search ..... 102/395, 498, 444, 445, 102/501, 517, 520–523, 529; 244/3.1, 3.24–3.3

[56] References Cited

U.S. PATENT DOCUMENTS

| | | | |
|---|---|---|---|
| 3,485,460 | 12/1969 | Mertens | 244/3.1 |
| 4,043,269 | 8/1977 | Ambrosini | 102/522 |
| 4,596,191 | 6/1986 | Glotz et al. | 102/529 |

FOREIGN PATENT DOCUMENTS

| | | | |
|---|---|---|---|
| 1678197 | 1/1968 | Fed. Rep. of Germany . | |
| 2286364 | 4/1976 | France | 102/529 |
| WO86/6827 | 11/1986 | PCT Int'l Appl. | 102/529 |
| 2091856 | 8/1982 | United Kingdom | 102/529 |

*Primary Examiner*—Harold J. Tudor

*Attorney, Agent, or Firm*—Stevens, Davis, Miller & Mosher

[57] ABSTRACT

High velocity projectiles are able to continue in flight for considerable distances beyond the normal target range. The present invention is a projectile for use in practice firing which becomes unstable after the normal target range has been exceeded and comprises a training round (1) having a body portion (3) engageable with a sabot (4) for projection from a rifled gun barrel, and a tapered nose portion (2) protrusive beyond the sabot, which is provided with a nose tip portion (6) having spin fins (9) extending in planes radial to the longitudinal axis. The fins increase the rate of spin decay and cause instability of the round and the fin geometry is chosen such that the instability occurs when the target range has been exceeded. The finned nose tip portion is separable from the round so as to permit selective attachment of a nose tip portion having fins specifically dimensioned for terminating the trajectory at a chosen safety range.

5 Claims, 4 Drawing Sheets

Fig. 6

| FIN TYPE | DIMENSIONS A mm | B mm | C mm | D mm | E mm | APPROX SINGLE SIDE AREA OF FIN $mm^2$ |
|---|---|---|---|---|---|---|
| A | 26·5 | 48·0 | 13·5 | 4·5 | 2·15 | 300 |
| B | 33·0 | 59·5 | 16·0 | 5·5 | 2·15 | 420 |
| C | 22·0 | 39·0 | 12·0 | 4·0 | 2·15 | 240 |
| D | 37·5 | 64·0 | 19·0 | 5·5 | 2·92 | 530 |
| E | 38·0 | 67·0 | 19·5 | 6·5 | 2·92 | 590 |
| UNFINNED ROUND DS/T | | | | | | ZERO |

SPIN-DAMPED TRAINING ROUND WITH SELECTABLE SAFETY TRACE

This application is a continuation of application Ser. No. 057,264, filed April 29, 1987, now abandoned.

This invention relates to range limited spin-stabilised practice projectiles. In particular, it relates to training rounds for which the range limitation has no substantial effect on the trajectory of the round within a target range but acts to curtail the range thereafter so as to prevent rounds which miss the target from exceeding the boundaries of the practice area.

Training rounds are known for which the total range, that is the maximum distance that the round is able to travel in a horizontal direction, is limited, the round being caused to fall to the ground by various means after a target range has been exceeded. The thus curtailed range is known as the safety trace. One such training round breaks up into several unstable portions after heat generated by air friction has softened portions having a low melting point. A second known training round comprises a spun tube which becomes unstable due to increased drag caused by choking. A third known training round has a series of radial ducts to vent air scooped in at the nose of the round. The air so vented breaks the spin and causes the round to become unstable.

It is also known to increase spin decay by the use of spin damping fins located forward of the centre of gravity of the round in planes radial to its longitudinal axis. For a spin stablised projectile a stability criterion exists and has been shown (by Fowler et al in Phil. Trans. Roy Soc. (A), 221,1920 and Murphy in a BRL Report 1963 entitled "Free flight motion of symmetric missiles") to be given by the inequality $Sg > 1$, where Sg is the gyroscopic stability factor and is given by the expression:

$$S_g = \frac{2q^2\ Ix^2}{d^3 Iy\ Cm\alpha\ \pi_p}$$

in which q is the spin speed of the projectile in rad $m^1$; Ix is the axial moment in inertia of the projectile: $\rho$ is the air density; d is the reference diameter of the projectile; Iy is the transverse moment of inertia of the projectile and $Cm\alpha$ is the aerodynamic over-turning moment slope.

As d, Ix and Iy are fixed and $\rho$ and $Cm\alpha$ only vary slightly for low angle, high velocity trajectories, Sg is mainly determined by the spin speed q. However, $q = P/V$, where P is the spin rate in rads $^{-1}$ and V is the velocity of the projectile. In the course of a normal trajectory the velocity decay is greater than the spin rate decay, thus the value of q increases and the projectile becomes more stable. If the spin damping of the projectile is increased sufficiently for the spin rate decay to exceed the velocity decay, S will decrease in flight and a projectile which started off stable can be caused to become unstable after travelling a critical distance.

The present invention seeks to use this effect to provide a range limited, spin-stabilised training round wherein the spin rate can be selectively attenuated. Further, it is important that the handling and firing characteristics of any training round should resemble as closely as possible the combat round that it is simulating, and the invention therefore also seeks to apply spin damping fins to a discard sabot round in a manner that does not interfere with the sabot design.

Accordingly the present invention comprises a training round including sub-caliber projectile including a body portion engageable in a discard sabot for projection from a rifled gun barrel and having a tapered nose portion protrusive beyond the sabot through an aperture in the sabot, wherein the protrusive nose portion includes a nose tip portion provided with an axially symmetric array of spin damping fins, each extending in a plane extending radially of the longitudinal axis of the training round and extending a radial distance no greater than the diameter of the sabot aperture.

Preferably the nose tip portion is separable from the nose portion, both portions being provided with inter-engageable attachment means thereby to permit selective attachment of any one of a number of nose tip portions each of which has been provided with spin-damping fins specifically dimensioned for engendering loss of stability of the round and consequent termination of its trajectory at a chosen safety trace.

Conveniently, the nose tip portion and the nose portion may have mating end faces transverse to the longitudinal axis which are respectively provided with a threaded axial spigot and a corresponding threaded axial recess comprising the inter-engageable attachment means.

The sub-projectile according to the present invention preferably has spin damping fins which are tapered and chamfered at their leading edges. Preferably the fins have flat surfaces in planes substantially parallel to the longitudinal axial cross-section through the sub-projectile.

The sub-projectile according to the present invention preferably has a nose tip portion having four spin damping fins extending at mutual right angles. For example, preferably the fins in such an arrangement of fins is such that the ratio R of the single side surface area of each fin in $mm^2$ to the greatest diameter of the sub-projectile in mm is not greater than 6.0. For example, for a 72 mm diameter sub-projectile for firing from a 120 mm gun the single side fin area is preferably about 420 mm, R being about 5.8.

In another aspect, the present invention also provides a training round comprising a sub-projectile and a discarding sabot located on the sub-projectile to launch the sub-projectile from a gun. Preferably, the internal diameter of the sabot at its front end is not less than the diametral distance from the longitudinal axis of the sub-projectile to the outer lateral edge of each fin as measured in a plane perpendicular to the longitudinal axis.

An embodiment of the invention will now be described by way of example only with reference to the accompanying drawings of which:

Figure 1:
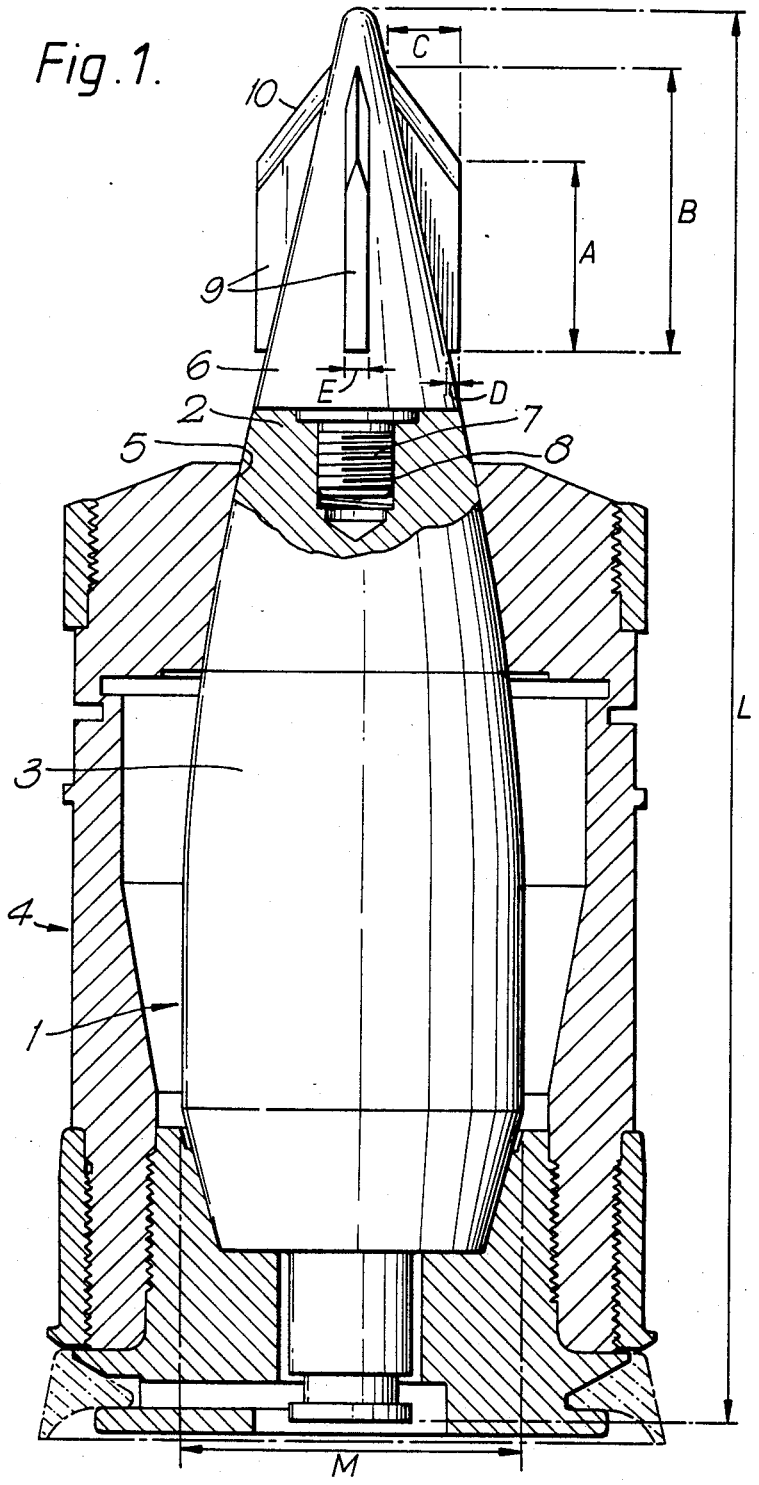
FIG. 1 is an axially part-sectioned side elevation of a training round having a finned nose tip portion and engaged in an axially sectioned sabot.
Figure 2:
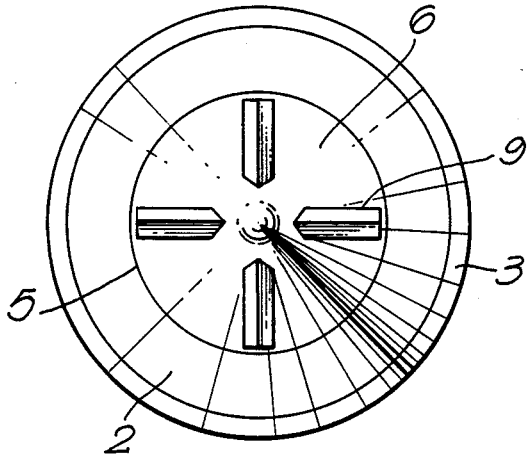
FIG. 2 is an axial elevation of the nose tip portion.
Figure 4:
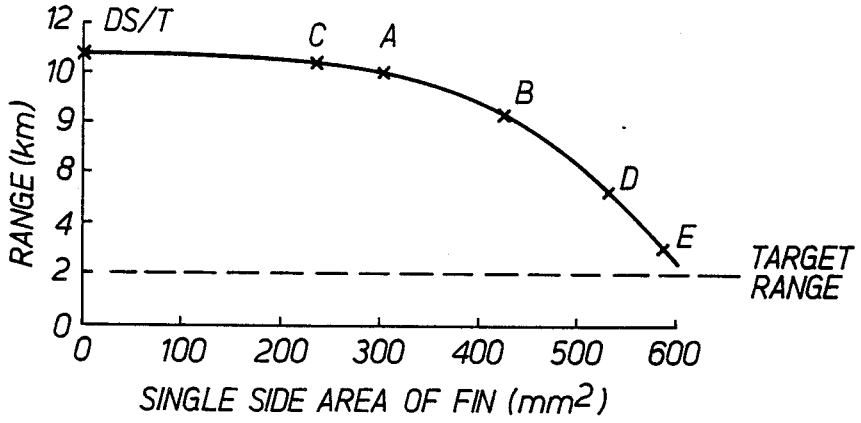
Figure 5:
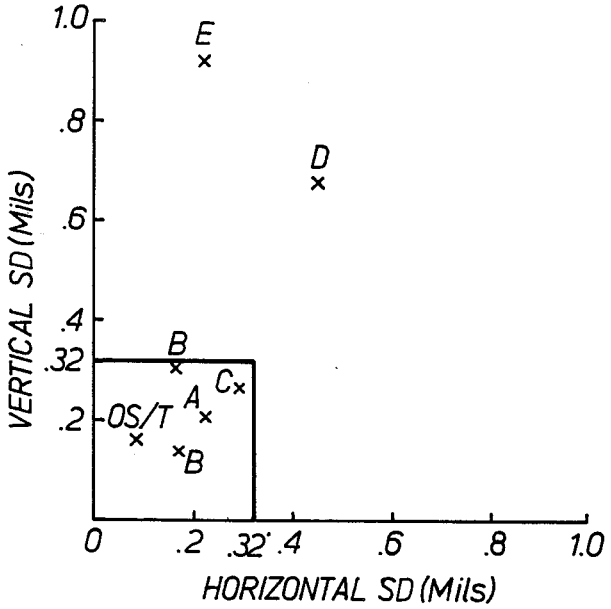

FIGS. 4 and 5 show the results of a series of firing trials made with specifically dimensioned nose tip portions in accordance with the general configuration of FIG. 1 and 2; and FIG. 6 lists the specific dimensions relevant to FIGS. 4 and 5.

FIG. 1 depicts a training round 1 having a tapered nose substantially conical portion 2 and a body portion 3 engaged in a discarding sabot 4. The nose portion 2 which protrudes through an end aperture 5 in the sabot 4, is provided with a separable nose tip portion 6 attached by means of a threaded spigot 7 engaged in a threaded socket 8. The nose tip portion 2 is provided with four fins 9, each mounted in a plane radial to the longitudinal axis of the round 1 in mutually equispaced configuration (see FIG. 2). The fins 9 do not protrude radially beyond the overall diameter of the aperture 5 In other words, as shown in FIG. 1, fins 9 extend radially to an extent C which is less than the radius of aperture 5. This ensures that the training round 1 can be engaged with a standard sabot 4 designed for use with an unfinned round. Each fin 9 has a chamfered leading edge 10 in order to reduce the axial drag of the fin.

The provision of the fins 9 on the nose tip portion 2 causes the rate of spin imparted at firing to decay at a faster rate than that of a similar unfinned round. Normally an unfinned round will increase its gyroscopic stability during flight because the axial velocity will decay faster than the rate of spin, but the finned, spin-damped round has a decreasing gyroscopic stability during flight because its rate of spin is caused to decay faster than the axial velocity. This effect causes the finned round to become unstable in flight and consequently to terminate its trajectory rapidly thereafter.

Figure 3:
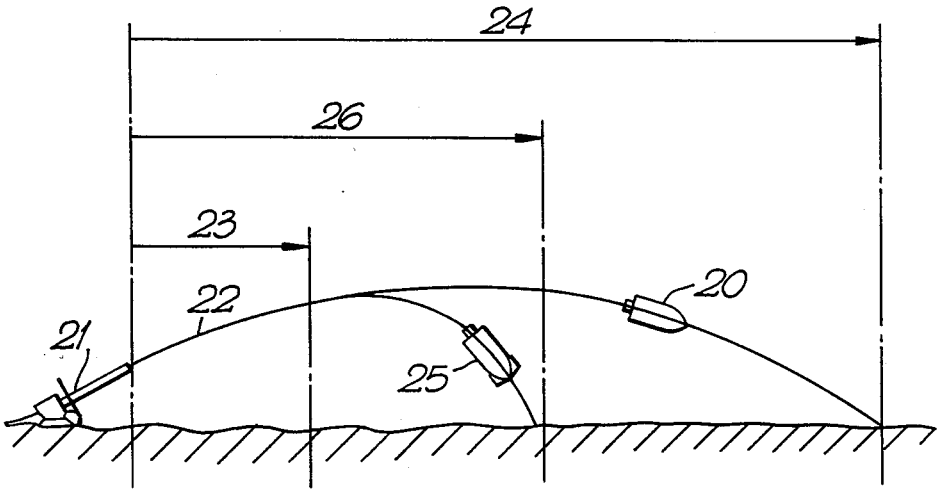
FIG. 3 is a diagrammatic representation of a range-limited and a non-range limited round trajectory.

This effect is illustrated in FIG. 3 in which non-finned round 20 fired from a gun 21 follows a trajectory 22 until it reaches a target range 23. If no target is hit directly or if the round 20 ricochets off the target, the round will then continue in flight until a total range 24 is attained. A finned round 25 follows the same trajectory as the non-finned round 20 until the target range 23 is reached, but thereafter the gyroscopic stability of the round becomes sufficiently low to cause it to fall to the ground at a limited range 26.

A typical target range 23 will be 2 to 4 km and the maximum range for a 120 mm discarding sabot combat round may be 20 km. Existing training rounds having identical configuration with the combat round but a differing mass have been produced with a reduced total range which limits the safety trace still further to a limit suitable for specific training areas. This is achieved by selective use of nose tip portions 6 having fins 9 specifically dimensioned for that purpose as will now be described with respect to a 120 mm discard sabot round.

A sequence of nose tip portions 6 was prepared, each having the general fin configuration shown in FIG. 1, the fins of each having a single-side fin area of differing dimensions ranging from 200 $mm^2$ to 600 $mm^2$, the specific dimensions of which are identified in Table 1 with reference to FIG. 1. These nose tip portions were all prepared for use with a round having an overall length L=287 mm and a maximum diameter M=72 mm. The results of firing trials made with round fitted with this sequence of nose tip portions are shown in FIGS. 4 and 5, FIG. 4 being a plot of total range against single side area of fin and FIG. 5 illustrating the dispersion associated with each fin size at a target range of 2 km.

It will be seen from FIG. 4 that a single side fin area up to 250 $mm^2$ has no significant spin-damping effect but the damping engendered by larger fins causes an increasingly worthwhile reduction in total range.

The spin damping fins cause the round to approach the unstable spin rate slowly which results in the round being marginally gyroscopically stable for a considerable distance before trajectory termination. This can cause a higher dispersion than a non-finned round would have, as is indicated in FIG. 5. The 0.32 mils by 0.32 mils box in this figure denotes the maximum acceptable deviation for a combat round. It will be seen that, for this particular example, the largest fin area having a dispersion within the limits required for a combat round is Fin Type B which provides a reduced safety trace of 8 Km (see FIG. 4).

When training is to take place on a firing ranger requiring an even shorter safety trace the effect upon performance assessment of the higher dispersion of increased fin areas can be readily calculated from the pre-determined dispersion characteristics, and where a fire control computer is used, this can be effected by a simple modification to the computer program.

A training projectile for the same uses as that of the present invention is described by AB Bofors in UK Patent Specification GB 2091856A. That projectile herein called the "Bofors Projectile" may have fins for the purpose of damping the spin of the projectile. The present invention was invented in 1977 but was not made the subject of a patent application until 1986 after the trials work had been completed. It is apparent that the Bofors Projectile was independently invented and developed and was made the subject of a patent application during the period when the projectile according to the present invention was being developed.

In any event, the present invention demonstrates a valuable inventive step over the Bofors Projectile as described in GB 2091856A for the following reasons. In column 1 lines 36 to 65 of GB 2091856A the use on the nose section of a projectile of means (known prior to the Bofors projectile) to damp the rotation of the projectile is discussed. Such means include channels and or shovels to deflect the axial air flow as proposed in German Patent Specification No 1,678,197. It is a suggested in GB 2091856A that the use of such means on the nose section are disadvantageous because they make the projectile comparatively complicated and expensive, and they make the projectile difficult to modify for different firing distances and there is a risk that the ballistic properties of the projectile even up to the actual firing distance are changed.

By the present invention we have demonstrated that unexpectedly, the use of fins on the nose section of a projectile does not cause the aforementioned apparent disadvantages to be significant. In fact, the last mentioned feature, which is the most important, namely a possible change in the ballistic properties, has been found substantially not to occur as demonstrated by the results described above with references to FIGS. 4 and 5. Furthermore, the use of fins on the nose section surprisingly offers the following advantages compared with the fins on the cylindrical body as in the Bofors projectile.

Interchangeable nose sections having different fin shapes and sizes may be fitted into a standard body. Because only the extremity of the projectile, i.e. the nose tip portion, is required to be changed when a different target distance is to be achieved the cost of producing different training rounds for different target distances is minimised. Furthermore, because the nose tip portion contains a natural slope the fins can be accommodated on this section with sufficiently large surface area to give suitable spin damping but without protruding transversely beyond the diameter of the cylindrical body behind the nose as in the Bofors Projectile. This advantageous feature allows the training projectile according to the present invention to be fitted with a standard discarding sabot (as used for a combat round of the same calibre) e.g. with the front aperture of the sabot located directly on the cylindrical body of the training projectile. It also allows the projectile to be used as a full calibre training projectile, if required, in contrast to the Bofors Projectile. Another advantageous feature of the use of fins upon the nose section is that the aerodynamic drag upon the projectile is reduced because the overall length-to-diameter of the projectile ratio is not increased by the presence of the fins (as in the Bofors Projectile). This allows greater dependence of the stability of the projectile upon the spin rate (the damping of which in turn can be controlled by the fin size) rather than on the ratio of spin rate : velocity.

I claim:

1. A training round of ammunition having a longitudinal axis, comprising:

a discarding sabot; and a sub-caliber projectile engaged partially within an open region within said sabot and having a body portion with a tapered nose portion protruding out of said sabot through an aperture in one end of said open region of said sabot in a direction of intended flight of said projectile, said nose portion including a nose tip portion having an axially symmetric array of spin damping fins each of which is oriented substantially within a plane extending radially of said longitudinal axis and extends radially to an extent not radially beyond the diameter of said aperture, said spin damping fins thereby not protruding radially from said body portion at any point within said sabot, said projectile further including an attachment means for mechanically attaching said nose tip portion with a remaining portion of said body portion to enable said nose tip portion to be attached and detached from said remaining portion, whereby a plurality of different nose tip portions having different spin damping characteristics can be selectively attached and detached to said remaining portion of said body portion.

2. A training round as claimed in claim 1 wherein said attachment means comprises mating end faces of the nose tip portion and the nose portion, said end faces being oriented transverse to the longitudinal axis and respectively provided with a threaded axial spigot and a corresponding threaded axial recess comprising the inter-engageable attachment means.

3. A training round as claimed in claim 1 wherein the spin damping fins are tapered and chamfered at their edges which face forwardly in said intended direction of flight.

4. A training round as claimed in claim 1 wherein the nose tip portion has four spin damping fins extending at mutual right angles.

5. A training round as claimed in claim 3 and wherein the ratio of the surface area of a single side of each fin expressed in $mm^2$ to the maximum diameter of the sub-projectile expressed in $mm^2$ is not greater than 6.0.

* * * * *